US006135709A

United States Patent [19]

Stones

[11] Patent Number: 6,135,709

[45] Date of Patent: Oct. 24, 2000

[54] VACUUM PUMP

[75] Inventor: Ian David Stones, West Sussex, United Kingdom

[73] Assignee: The BOC Group plc, Windlesham, United Kingdom

[21] Appl. No.: 09/316,121

[22] Filed: May 20, 1999

[30] Foreign Application Priority Data

May 20, 1998 [GB] United Kingdom ..... 9810872

[51] Int. Cl.[7] ..... F04D 19/04

[52] U.S. Cl. ..... 415/90; 415/143

[58] Field of Search ..... 415/90, 143; 417/423.4

[56] References Cited

U.S. PATENT DOCUMENTS 5,120,208 6/1992 Toyoshima et al. ..... 418/201.3

5,611,660 3/1997 Wong et al. ..... 415/90

5,893,702 4/1999 Conrad et al. ..... 415/71

FOREIGN PATENT DOCUMENTS 0 805 275 A2 11/1997 European Pat. Off. .

*Primary Examiner*—Edward K. Look

*Assistant Examiner*—Rhonda Barton

*Attorney, Agent, or Firm*—Salvatore P. Pace

[57] ABSTRACT

A vacuum pump comprising at least a molecular drag section and a turbo-molecular section, a rotor common to both sections and a stator common to both sections. The turbo-molecular section is positioned wholly within an envelope defined by the molecular drag section.

6 Claims, 3 Drawing Sheets

VACUUM PUMP

BACKGROUND OF THE INVENTION

The present invention relates to vacuum pumps and in particular to "hybrid" or compound vacuum pumps which have two or more sections of different operational mode for improving the operating range of pressures and throughput.

In European Patent Publication No. 0 805 275, for example, there is described a compound vacuum pump which consists of a regenerative section combined with a molecular drag section.

In European Patent Publication No. 0 643 227 there is described a compound vacuum pump having a turbo-molecular section and a molecular drag section.

A disadvantage of known compound vacuum pumps is that they tend to be bulky and there remains a need to improve compound vacuum pumps to increase efficiency whilst maintaining overall dimensions as small as is practicable.

It is an aim of the present invention to provide a compound vacuum pump having a turbo-molecular section and at least a molecular drag section which makes very efficient use of space when mounting the sections together.

SUMMARY OF THE INVENTION

According to the present invention, a vacuum pump comprises at least a molecular drag section and a turbo-molecular section, a rotor common to both sections and a stator common to both sections in which the turbo-molecular section is positioned substantially wholly within an envelope defined by the molecular drag section.

In a preferred embodiment the turbo-molecular section comprises a stator formed with an array of radially extending stationary stator vanes and a rotor formed with an array of radially extending vanes arranged for rotation between the stator vanes, and in which the molecular drag section is a Holweck section comprising alternate stationary and rotating cylinders, the stationary cylinders being mounted on the stator and the rotating cylinders being mounted for rotary movement with the rotor.

Preferably, the stator vanes and the rotor vanes define a plurality of spaced arrays, the diameter of the arrays of vanes decreasing in a direction towards the Holweck inlet stage and in which the cylinders of the Holweck section decrease in length in a direction towards the longitudinal axis of the rotor.

This orientation is advantageous in that to achieve good inlet speed, the inlet stage of the turbo-molecular pump section needs maximum area with subsequent stages requiring less area. This leaves space for the molecular drag stages to be fitted around the lower turbo-molecular stages without extending the overall pump diameter beyond that of the inlet stage of the turbo-molecular section.

Preferably, the compound vacuum pump has a third regenerative section.

An embodiment of the invention will now be described by way of example reference being made to the Figures of the accompanying diagrammatic drawings in which:

DETAILED DESCRIPTION

Figure 1:
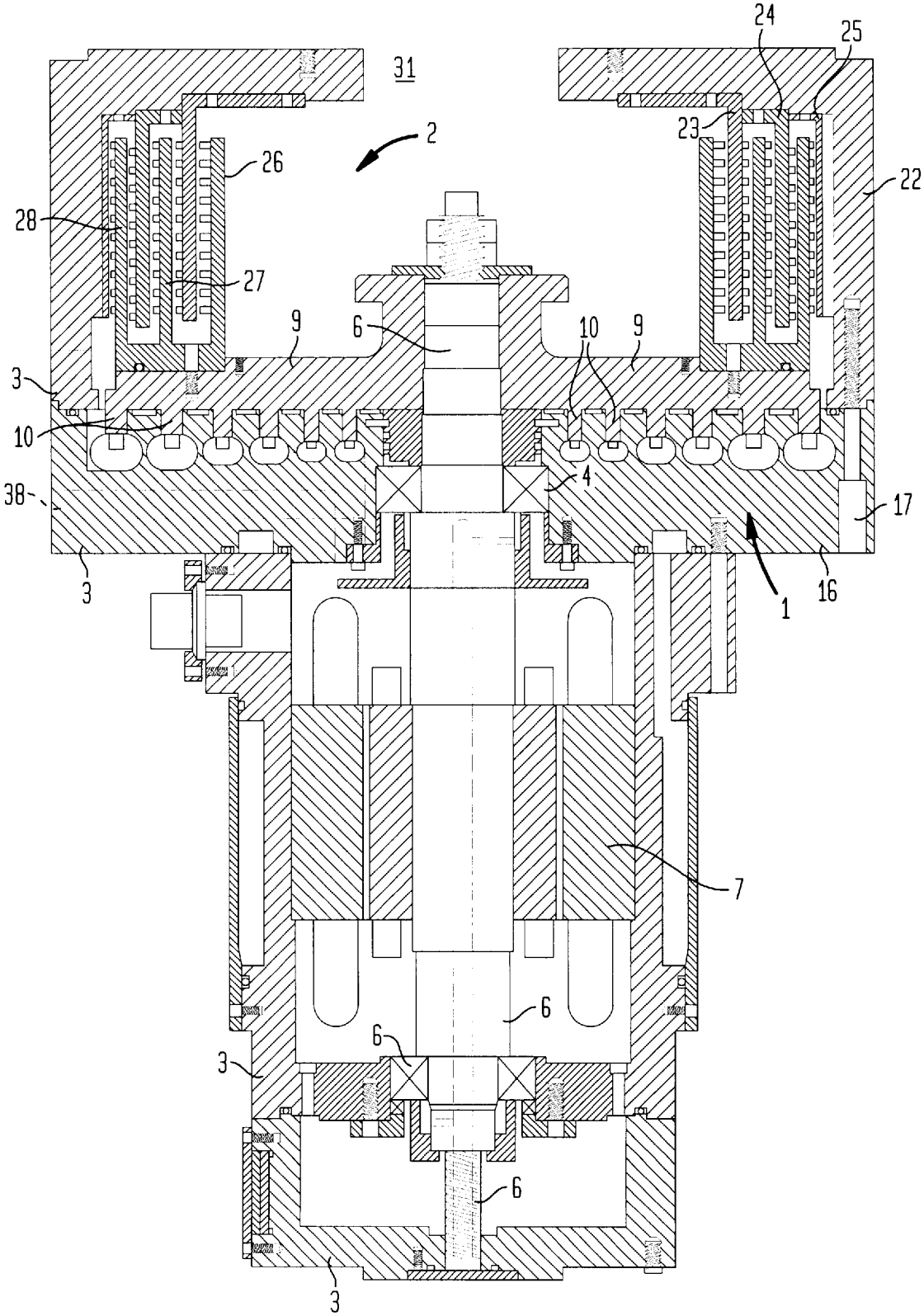
FIG. 1 (PRIOR ART)
FIG. 1 is a cross section through a compound vacuum pump having a Holweck section and a regenerative section (prior art)

Referring to FIG. 1, there is illustrated a known compound vacuum pump comprising a regenerative section 1 and a molecular drag (Holweck) section 2. The pump includes a housing 3 made from a number of different body parts bolted or otherwise fixed together and provided with relevant seals therebetween.

Mounted within the housing 3 is a shaft 6 supported by an upper (as shown) bearing 4 and a lower (as shown) bearing 5. The shaft 6 is rotatable about its longitudinal axis and is driven by an electric motor 7 surrounding the shaft 6.

Securely attached to the shaft 6 for rotation therewith is a rotor 9 which overlies a body portion 16 of the housing 3. Attached to the body portion 16 by means of bolts 17 (only one shown) is a body portion 22 which forms part of the Holweck section 2. The body portion 22 includes a central inlet 31 for the Holweck section 2. Depending from the body portion 22 and forming the stator for the Holweck section are a set of three hollow annular cylinders 23, 24, 25 whose longitudinal axes are parallel to the longitudinal axis of the shaft 6 and the rotor 9.

A set of three further concentric hollow cylinders 26, 27, 28 whose longitudinal axes are also parallel to the longitudinal axis of the shaft 6 and the rotor 9 are securely fixed at their lower (as shown) ends to the upper surface of the rotor 9.

Each of the six cylinders 23 to 28 is mounted symmetrically about the main axis that is the longitudinal axis of the shaft 6 and, as shown, the cylinders of one set are interleaved with those of the other set thereby to form a uniform gap between each adjacent cylinder. This gap, however, reduces from the innermost adjacent cylinders 23, 26 to the outermost adjacent cylinders 25, 28.

Situated in the gap between each adjacent cylinder is a threaded flange (or flanges) which define a helical structure extending substantially across the gap. This flange can be attached to either of the adjacent cylinders.

Figure 2:
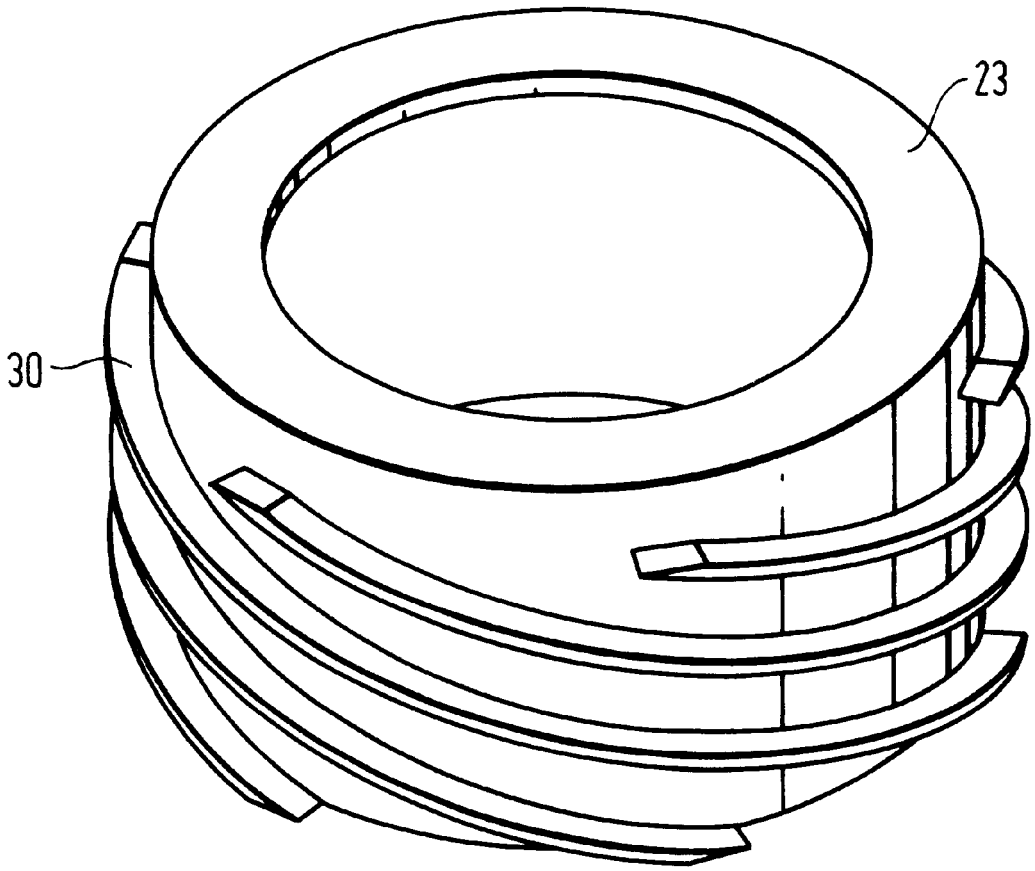
FIG. 2 is a perspective view of part of a cylinder used in the Holweck section of the pump of FIG. 1.

FIG. 2 shows part of the cylinder 23 with an upstanding flange 30 attached in the form of a number of individual flanges to form a helical structure. The other cylinders 24, 25 would have substantially the same construction.

As shown in FIG. 1, the rotor 9 is in the form of a disc the lower (as shown) surface of which has formed thereon a plurality of raised rings 10 which, as is known in the art, form part of the regenerative section 1 the details of which form no part of this invention.

In use, with the shaft 6 and rotor 9 spinning at high speed gas is drawn into the inlet 31 within the body portion 22 and into the gap between adjacent cylinders 23, 26. It then passes down the helix formed by the upstanding flange in the cylinder 26 and hence up the gap between the cylinders 23, 27 and so on until it passes down the gap between cylinders 26, 28. It then passes through porting not shown in a manner known per se into the inlet of the regenerative section 1 and hence out to atmosphere via an outlet 38.

According to the present invention, a further turbo-molecular section 50 is added to the known compound vacuum pump illustrated in FIG. 1. In particular, the turbo molecular section 50 is enveloped by the Holweck section 2.

Figure 3:
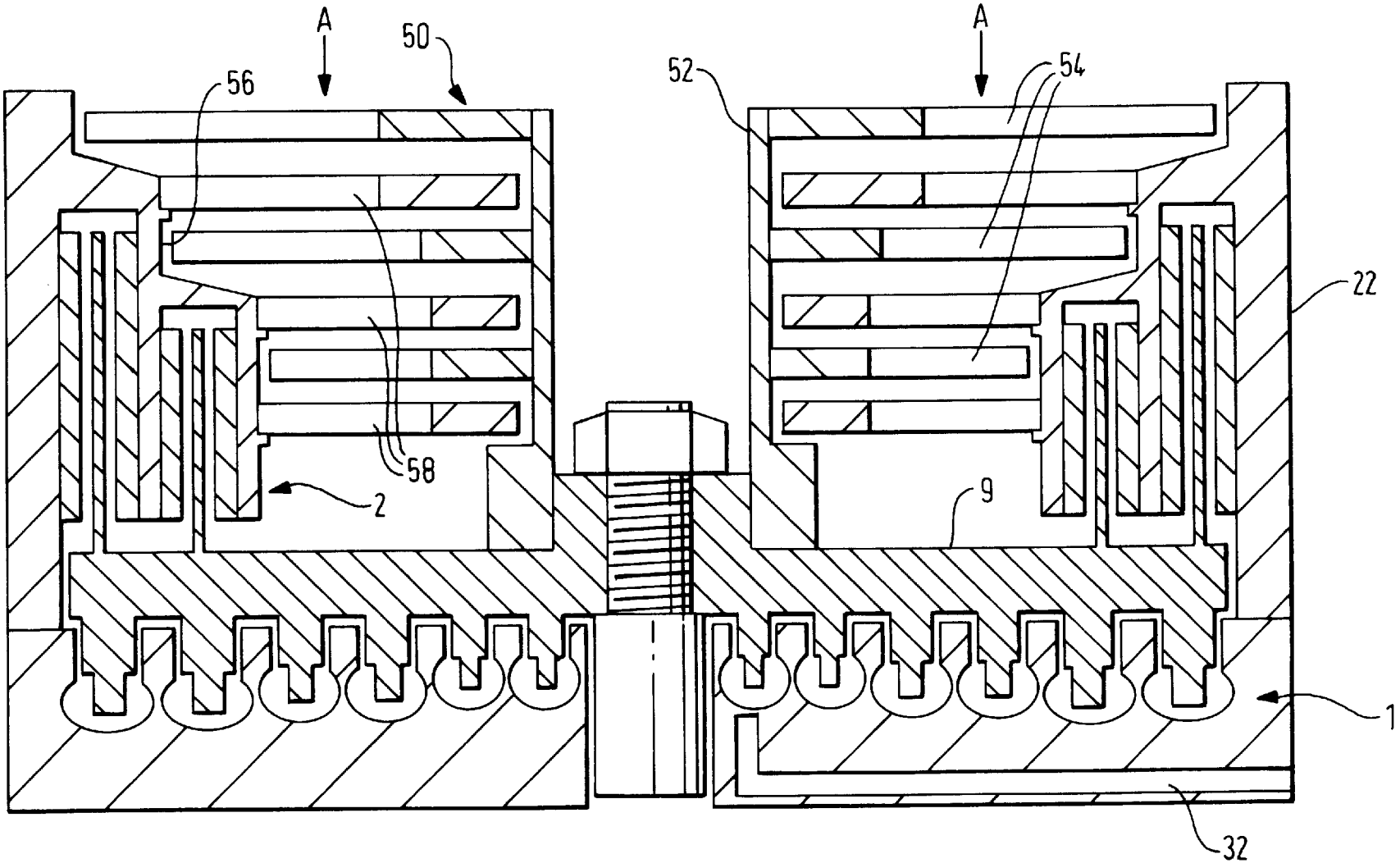
FIG. 3 is a cross-section through a compound vacuum pump according to the present invention.

Referring now to FIG. 3 where like reference numerals denote like parts, mounted on the rotor 9 for rotary movement therewith is a cylindrical rotor body 52 from which extend radially outwardly therefrom rotor vanes 54 which collectively define three spaced arrays of vanes, each array having in the region of 20 such vanes.

Section 50 also comprises a stator 56 which is formed with and within the body portion 22 and from which radially extend a plurality of stator vanes 58 again defining three spaced arrays of vanes each array consisting of about 20 vanes. As shown, the arrays of rotor vanes 54 interleave with the arrays of the stator vanes 58, the vanes 54, 58 being angled relative to each other in a manner known per se in turbo molecular vacuum pump technology.

In operation, gas is drawn through the turbo-molecular section within the stator 56 in the direction shown by the arrows A towards the lower stage outlet beyond the third annular array of stator vanes and hence into the Holweck section 2. As previously explained the gas will then leave the Holweck section and enter the regenerative section 1 in a manner known per se and exit the compound vacuum pump via the outlet 38.

It will be observed that in the above described embodiment the turbo-molecular section 50 is totally enveloped within the molecular drag section 2.

To achieve good inlet speed the inlet stage of the turbo-molecular pump section 50 needs maximum area so that the (upper) as shown vane array 54 has a larger diameter than the remaining vane arrays. This in the past has been achieved by increasing the rotor hub diameter of the subsequent stages and maintaining the outer diameter of the rotor vanes thus keeping a maximum tip speed.

However, in the above described embodiment where the hub diameters are kept substantially the same and the tip diameters of the rotor vanes are reduced it has been found that performance loss is not too great. This, as a consequence, leaves space for the molecular drag stages to be mounted around the lower turbo-molecular stages without extending the pump diameter beyond that of the inlet turbo-molecular stage, that is the upper vane array of the turbo-molecular section.

As shown, the stages of the Holweck section can be mounted concentrically with inner stages being shorter thus allowing the turbo-molecular stages to be stepped down gradually. Molecular drag stages are more restrictive to flow than turbo-molecular stages thus mounting the molecular drag stages at a larger diameter increases the tip speed and improves the flow rate.

The regenerative section 1 follows the molecular drag section as is known in the art but could be replaced by some other mechanism or even a separate vacuum pump.

I claim:

1. A vacuum pump comprising:

at least a molecular drag section;

a turbo-molecular section;

a rotor common to both sections; and a stator common to both sections;

the turbo-molecular section positioned wholly within an envelope defined by the molecular drag section.

2. The vacuum pump as claimed in claim 1, in which the turbo-molecular section comprises a stator formed with an array of radially extending stationary stator vanes and a rotor formed with an array of radially extending vanes arranged for rotation between the stator vanes, and in which the molecular drag section is a Holweck section comprising alternate stationary and rotating cylinders, the stationary cylinders being mounted on the stator and the rotating cylinders being mounted for rotary movement with the rotor.

3. The vacuum pump as claimed in claim 2, in which the Holweck cylinders each have a longitudinal axis parallel to the longitudinal axis of the rotor.

4. The vacuum pump as claimed in claim 2 or 3, in which the stator vanes define a plurality of spaced arrays and the rotor vanes define a similar plurality of spaced arrays, the diameter of the arrays of vanes decreasing in a direction towards an inlet stage of the Holweck section.

5. The vacuum pump as claimed in claim 2 in which the cylinders of the Holweck section decrease in length in a direction towards the longitudinal axis of the rotor.

6. The vacuum pump as claimed in claims 1 in which the pump has a third regenerative section.

* * * * *